US008833350B1

(12) United States Patent
Specht

(10) Patent No.: US 8,833,350 B1
(45) Date of Patent: Sep. 16, 2014

(54) METHOD AND APPARATUS FOR SUPPORTING BOW AND ARROW

(76) Inventor: William F. Specht, Elberta, AL (US)

( * ) Notice: Subject to any disclaimer, the term of this patent is extended or adjusted under 35 U.S.C. 154(b) by 261 days.

(21) Appl. No.: 13/317,092

(22) Filed: Oct. 11, 2011

(51) Int. Cl.
*F41B 5/18* (2006.01)

(52) U.S. Cl.
USPC ..... 124/35.2; 124/86

(58) Field of Classification Search
USPC ..... 124/35.2, 86, 88
See application file for complete search history.

(56) References Cited

U.S. PATENT DOCUMENTS 5,156,138 A * 10/1992 Grover ..... 124/35.2
5,240,211 A 8/1993 Anderson
5,619,981 A 4/1997 Breedlove
5,671,723 A * 9/1997 Goff et al. ..... 124/35.2
5,944,004 A * 8/1999 Goff et al. ..... 124/35.2
6,029,643 A 2/2000 Golfieri
6,161,532 A * 12/2000 Goff et al. ..... 124/35.2
6,425,765 B1 7/2002 Irwin, III
7,311,097 B1 12/2007 Callis
7,347,402 B2 * 3/2008 White ..... 248/181.1
7,434,773 B1 10/2008 Minjares

* cited by examiner

*Primary Examiner* — John Ricci
(74) *Attorney, Agent, or Firm* — George L Williamson

(57) ABSTRACT

A bow and arrow support which allows a disabled individual to use the bow and arrow with some help from an assistant. Disclosed is a vertical support for the bow wherein the primary vertical support is elevated on an upright member which is supported by a base member. Also disclosed is a primary horizontal support member to which a trigger mechanism is attached so that the assistant can pull the string of the bow backwardly to a point where the trigger mechanism can grasp the string firmly. Thereafter, the assistant can step away and the disabled user can approach the bow and arrow and then fire the bow and arrow by actuating the trigger mechanism.

20 Claims, 2 Drawing Sheets

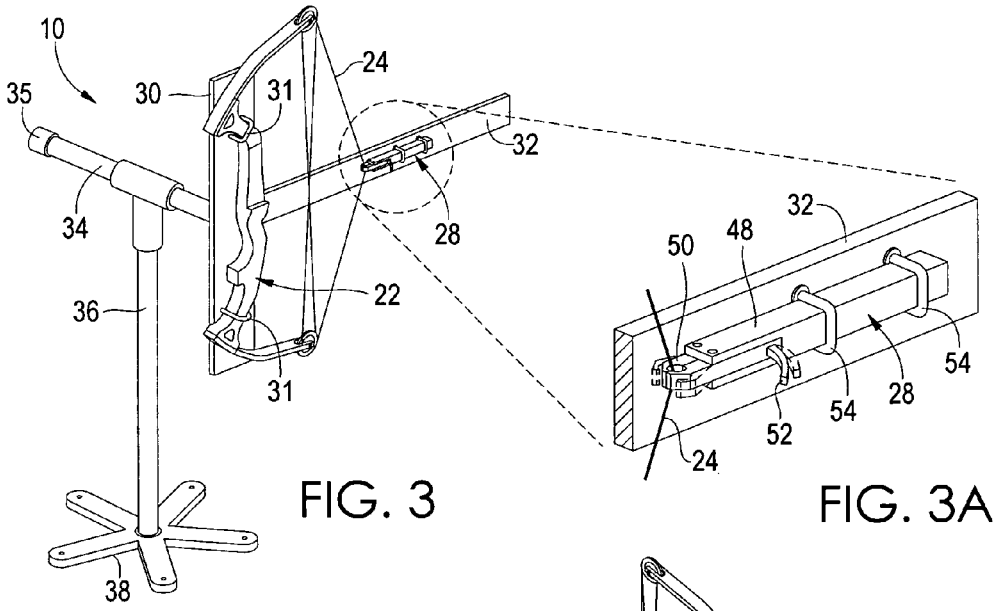
FIG. 3
FIG. 3A
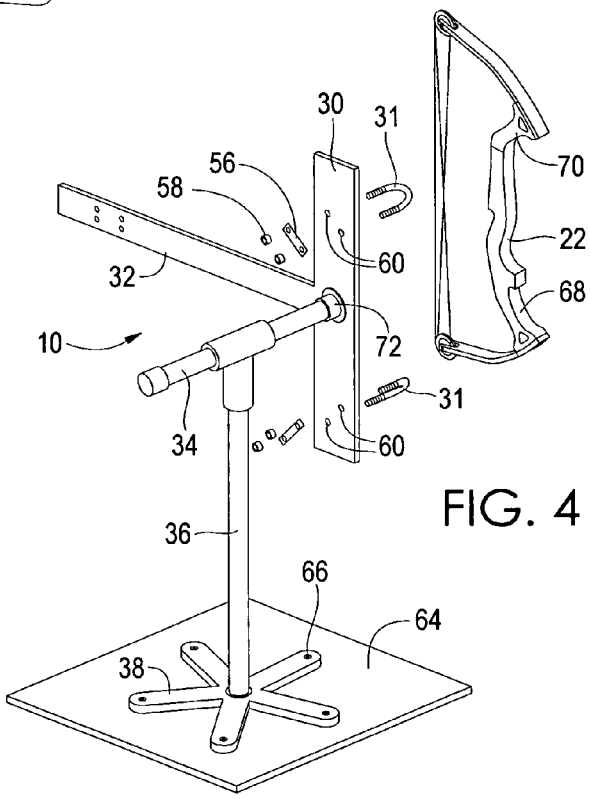
FIG. 4

METHOD AND APPARATUS FOR SUPPORTING BOW AND ARROW

BACKGROUND OF THE INVENTION

1. Field of the Invention

The present invention relates generally to bow and arrows and, more particularly, is concerned with a method and apparatus for supporting a bow and arrow for use by a disabled person.

2. Description of the Related Art

Bow and arrow supports have been described in the related art, however, none of the related art devices disclose the unique features of the present invention.

In U.S. Pat. No. 7,311,097 dated Dec. 25, 2007, Callis disclosed a bow construction including a telescoping bow riser and ground support. In U.S. Pat. No. 6,029,643 dated Feb. 29, 2000, Golfieri disclosed a bow sighting unit and stand. In U.S. Pat. No. 5,240,211 dated Aug. 31, 1993, Anderson disclosed a bow support apparatus. In U.S. Pat. No. 6,425,765 dated Jul. 30, 2002, Irwin, III, disclosed a training device for archers. In U.S. Pat. No. 7,434,773 dated Oct. 14, 2008, Minjares disclosed an adjustable support for archery bows and the like. In U.S. Pat. No. 5,619,981 dated Apr. 15, 1997, Breedlove disclosed an archery bow stabilizer and prop. While these bow and arrow supports may be suitable for the purposes for which they were designed, they would not be as suitable for the purposes of the present invention as hereinafter described.

SUMMARY OF THE PRESENT INVENTION

The present invention discloses a method and apparatus for supporting a bow and arrow in such a way that a disabled individual, particularly one confined to a wheelchair, can use the bow and arrow with some help from an assistant. Disclosed therein is a primary vertical support to which the bow is attached wherein the primary vertical support is elevated on an upright post-like member which post-like member is supported by a ground contacting base member. The primary vertical support, to which the bow is attached, has a primary horizontal support member to which a trigger mechanism is attached so that the assistant can pull the string of the bow backwardly to a point where the trigger mechanism can grasp the string firmly. Thereafter, the assistant can step away and the disabled user can approach the bow and arrow and then fire the bow and arrow by actuating the trigger mechanism. The stand to which the bow and arrow is attached allows the bow and arrow to be aimed both in a vertical plane and a horizontal plane.

An object of the present invention is to allow a disabled person to use a bow and arrow. A further object of the present invention is to allow a bow and arrow to be mounted on a support so that the bow and arrow can be aimed as it is being fired by a disabled person. A further object of the present invention is to provide a bow and arrow which requires minimal aid from an assistant for use so that the bow and arrow can be used by the disabled person. A further object of the present invention is to provide a bow and arrow which can be easily used by a disabled person. A further object of the present invention is to provide a method and apparatus for a bow and arrow which can be relatively easily and inexpensively manufactured.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 3 is a perspective view of the present invention.

FIG. 3A is a perspective view of the trigger mechanism of the present invention.

FIG. 4 is an exploded perspective view of the present invention.

LIST OF REFERENCE NUMERALS

Figure 1:
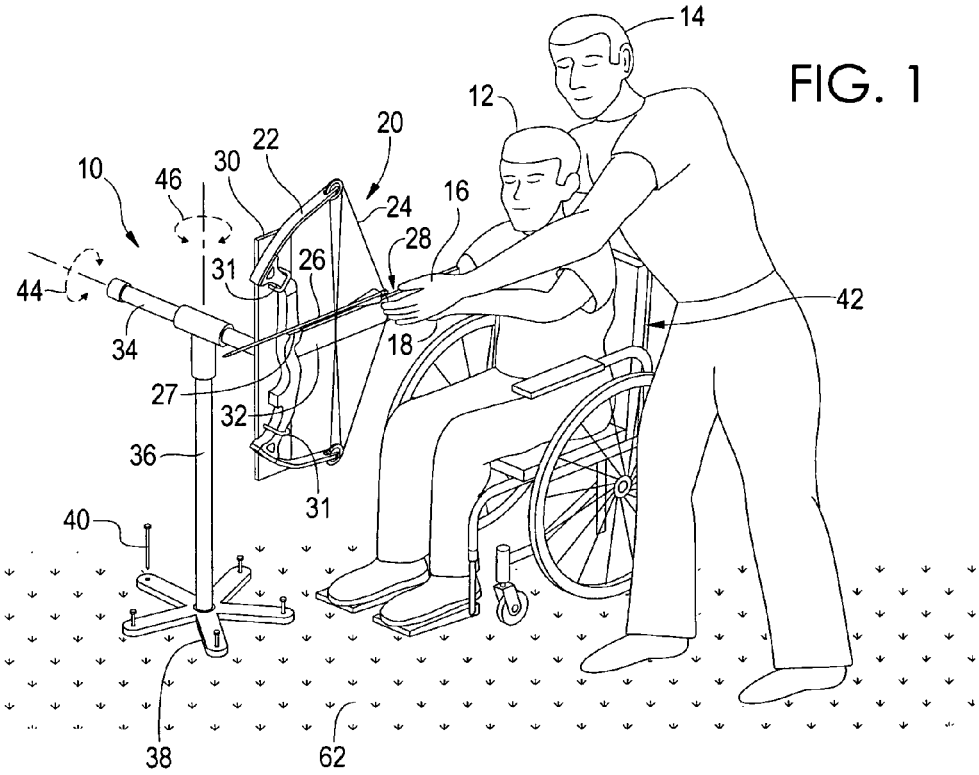
FIG. 1 is a perspective of the present invention in operative connection.

With regard to reference numerals used, the following numbering is used throughout the drawings.

10 present invention
12 user
14 assistant
16 hand of assistant
18 hand of user
20 bow and arrow
22 bow
24 string
26 arrow
27 arrow rest
28 trigger mechanism
29 nock of arrow
30 primary vertical support for bow
31 clamp means
32 primary horizontal support for trigger mechanism
34 horizontal member
35 handle
36 upright member
38 base
40 peg/stake
42 wheelchair
44 arrow
46 arrow
48 body
50 jaws
52 trigger
54 clamp means
56 bracket
58 fastener
60 apertures
62 ground
64 bottom member
66 fastener
68 lower limb
70 upper limb
72 connection

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of the complete scope of the invention the reader is directed to the appended claims. FIGS.

1 through 4 illustrate the present invention wherein a method and apparatus for supporting and using a bow and arrow is disclosed.

Figure 2:
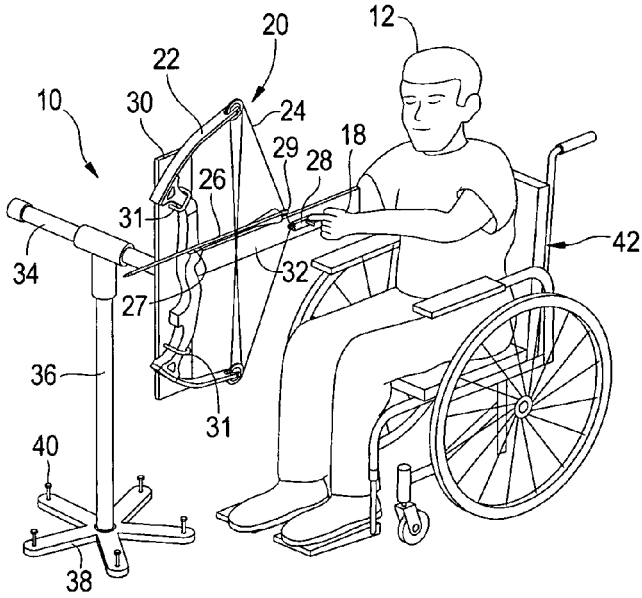
FIG. 2 is a perspective view of the present invention in operative connection.

Turning to FIGS. 1 and 2, therein is shown the present invention generally at 10 showing a user or archer 12 disposed in a wheelchair 42 along with an assistant 14. Also shown are the hands 16 of the assistant 14 and the hand 18 of the user 12 placed generally on the trigger mechanism 28 (not shown, see FIG. 3A). Also shown generally at 20 are the bow and arrow disposed in a conventional manner showing the bow portion 22 along with the string 24 and an arrow 26 and arrow rest 27 disposed on the bow in a conventional manner. A compound bow 22 is shown for illustration purposes, however, any type of bow could be used. Also shown is the first primary vertical support 30 for the bow along with a second primary horizontal support 32 for the trigger mechanism 28, a horizontal member 34 to which the primary vertical support 30 is attached, an upright post-like member 36, a ground contacting base member 38 along with a plurality of pegs or stakes 40 for insertion into the ground 62 for stabilizing post-like member 36 and base 38. It can be seen that the bow and arrow 20 can be aimed in a vertical plane as indicated by arrow 44 and in a horizontal plane as indicated by arrow 46. In operation, the assistant 14 uses his hand 16 in order to pull the string 24 from a first, relaxed position rearwardly toward the user 12 to a second, tightly drawn or taut position so that the string can be placed within the jaws of the trigger mechanism 28 (not shown, see FIG. 3A) and the arrow 26 is nocked. After the string 24 is placed within the jaws of the trigger mechanism 28 (not shown, see FIG. 3A), the assistant 14 can then step aside and allow the user 12 to independently aim and fire the bow and arrow 20. Also shown are U-bolt style clamps 31 or the like for securely attaching bow 22 to primary vertical support 30. One skilled in the art would understand that there are numerous devices to substitute for clamp 31, such as, metallic or fabric bands, straps, strings, tape or the like. One skilled in the art would understand that the individual members of the present invention 10 could be constructed in a unitary fashion, e.g., the bow 22 and first support 30 could be constructed as a unit as could other members. Also shown is the ground 62.

Turning to FIG. 2, therein is shown the present invention 10 as it is about to be fired by the user 12 who has his hand 18 on the trigger mechanism 28. After the string 24 is moved rearwardly to the second, taut position, the user or archer 12 is then able to independently release the arrow 26 using the trigger mechanism (not shown, see FIG. 3A) without any further help from the assistant. Also shown is the nock 29 of arrow 26 along with arrow rest 27 with the arrow being nocked onto the string 24.

Turning to FIGS. 3 and 4, therein is shown the present invention generally at 10. Also shown generally at 20 are the bow and arrow disposed in a conventional manner showing the bow portion 22 along with the string 24 and an arrow 26 disposed on the bow in a conventional manner along with the upper limb 70 and lower limb 68. Also shown is the primary vertical support 30 for the bow along with a first primary horizontal support 32 for the trigger mechanism 28, a second horizontal member 34, having a handle 35 thereon, to which the primary vertical support 30 is attached at connection 72, an upright post-like member 36 and a ground contacting base member 38, wherein the first and second supports have the shape of a "T" when viewed from the side. It can be seen that the bow and arrow 20 can be aimed in a vertical plane as indicated by arrow 44 and in a horizontal plane as indicated by arrow 46. Also shown are U-bolt style clamps 31 or the like for securely attaching bow 22 to primary vertical support 30. Also shown in conjunction with clamp 31 are bracket 56, fasteners 58 for attachment to clamp 31 and apertures 60 for passing clamp 31 through the primary vertical support 30. One skilled in the art would understand that there are numerous devices to substitute for clamp 31, such as, metallic or fabric bands, straps, strings, tape or the like. Also shown is an enlarged bottom member 64 which can be attached underneath base 38 using conventional fasteners 66, e.g., nut and bolt, wood screw or the like, for converting and using the present invention 10 indoors.

Turning to FIG. 3A, therein is shown the trigger mechanism 28 which is a conventional release aid for a bow and arrow. For illustration purposes only, the trigger mechanism 28 is shown herein; however, one skilled on the art would understand that there are many styles and designs of bow and arrow releases aids, e.g., single or double calipers or with or without wrist straps. Any type of release aid 28, could be used so long as it has a body 48 which can be mounted onto the primary horizontal support 32, jaws or calipers 50 for grasping string 24 thereinbetween, trigger 52 and a means 54 for mounting to primary horizontal support 32. The jaws 50 are spring-loaded and are biased toward a normally closed first position simultaneously to the trigger 52 being in a first position; the trigger can then be moved rearwardly by the hand of the user 12 or assistant 14 to a second position while at the same time the jaws 50 would be moved by the trigger to an open second position as shown in phantom line. The jaws 50 and trigger 52 are spring loaded and operate together so that the jaws move when the trigger is moved. The body 48 is disposed onto the primary horizontal support 32 by a clamp means 54, or the like, similarly as the bow 22 is disposed onto the primary vertical support 30.

In summary, and by reference to FIGS. 1 to 4, the method for supporting a bow and arrow, the bow having a string thereon, comprises the steps of: a) providing a first support 30, wherein the bow 22 is disposed on the first support in an upright position ready to be drawn; b) providing a second support 32; c) providing a trigger mechanism 28 on the second support in a position to receive a nock 29 of the arrow 26 when the bow and arrow is drawn, the trigger mechanism comprising at least one movable jaw 50 and a trigger 52, wherein the jaw and the trigger cooperate with each other so that the jaw moves in response to movement of the trigger between a first position, when the jaw is closed, to a second position when the jaw is open, wherein the string of the bow can be captured in the jaw when the jaw is in the first position and the bow and arrow is drawn and ready to be released; d) providing an upright member 36 for supporting the first support, the upright member having upper and lower end portions, wherein the upper end portion is connected to the first support at 72; and, e) providing a base 38 for supporting the apparatus 10, wherein the base is connected to the lower end portion of the upright member. Furthermore, wherein the first support can be rotated in a vertical plane to permit the bow and arrow to be turned from side to side; wherein the first support can be rotated in a horizontal plane to permit the bow and arrow to be aimed upwardly or downwardly; wherein the first support is substantially vertically disposed; wherein the second support is substantially horizontally disposed; further comprising the step of providing a handle 35 for rotating the first support; further comprising the step of providing a stake 40 for securing the base into a ground surface 62; further comprising the step of providing a bottom support 64 disposed underneath the base to permit the apparatus to be used indoors; and, wherein the first and second support are jointed together, wherein the first and second support have the shape of a "T" when viewed from the side (e.g., See FIG. 4).

I claim:

1. An apparatus for supporting a bow and arrow, the bow having a string thereon, comprising:

a) a first support, wherein the bow is disposed on said first support in an upright position ready to be drawn;

b) a second support extending from said first support;

c) a trigger mechanism being disposed on said second support not directly attached to said bow and in a position to receive a nock of the arrow when the bow and arrow is drawn, said trigger, mechanism comprising at least one movable jaw and a trigger, wherein said jaw and said trigger cooperate with each other so that said jaw moves in response to movement of said trigger between a first position, when said jaw is closed, to a second position when said jaw is open, wherein the string of the bow can be captured in said jaw when said jaw is in said first position and the bow and arrow is drawn and ready to be released;

d) an upright member for supporting said first support, said upright member having upper and lower end portions, wherein said upper end portion is connected to said first support; and, e) a base for supporting the apparatus, wherein said base is connected to said lower end portion of said upright member.

2. The apparatus of claim 1, wherein said first support can be rotated in a vertical plane to permit the bow and arrow to be turned from side to side.

3. The apparatus of claim 1, wherein said first support can be rotated in a horizontal plane to permit the bow and arrow to be aimed upwardly or downwardly.

4. The apparatus of claim 1, wherein said first support is substantially vertically disposed.

5. The apparatus of claim 1, wherein said second support is substantially horizontally disposed.

6. The apparatus of claim 1, further comprising a handle for rotating said first support.

7. The apparatus of claim 1, further comprising a stake for securing said base into a ground surface.

8. The apparatus of claim 7, further comprising a bottom member disposed underneath said base to permit the apparatus to be used indoors.

9. The apparatus of claim 1, wherein an upper limb and a lower limb of the bow are connected to said first support to permit the bow to be secured to said first support.

10. A method for supporting a bow and arrow, the bow having a string thereon, comprising the steps of:

a) providing a first support, wherein the bow is disposed on the first support in an upright position ready to be drawn;

b) providing a second support extending from said first support;

c) providing a trigger mechanism not directly connected to mid bow on the second support in a position to receive a nock of the arrow when the bow and arrow is drawn, the trigger mechanism comprising at least one movable jaw and a trigger, wherein the jaw and the trigger cooperate with each other so that the jaw moves in response to movement of the trigger between a first position, when the jaw is closed, to a second position when the jaw is open, wherein the string of the bow can be captured in the jaw when the jaw is in the first position and the bow and arrow is drawn and ready to be released;

d) providing an upright member for supporting the first support, the upright member having upper and lower end portions, wherein the upper end portion is connected to the first support; and, e) providing a base for supporting the apparatus, wherein the base is connected to the lower end portion of the upright member.

11. The method of claim 10, wherein the first support can be rotated in a vertical plane to permit the bow and arrow to be turned from side to side.

12. The method of claim 10, wherein the first support can be rotated in a horizontal plane to permit the bow and arrow to be aimed upwardly or downwardly.

13. The method of claim 10, wherein the first support is substantially vertically disposed.

14. The method of claim 10, wherein the second support is substantially horizontally disposed.

15. The method of claim 10, further comprising the step of providing a handle for rotating the first support.

16. The method of claim 10, further comprising the step of providing a stake for securing the base into a ground surface.

17. The method of claim 16, further comprising the step of providing a bottom support disposed underneath the base to permit the apparatus to be used indoors.

18. A method for using a bow and arrow by a disabled person, the bow having a string thereon, comprising the steps of:

a) providing a first support, wherein the bow is disposed on the first support in an upright position ready to be drawn;

b) providing a second support;

c) providing a trigger mechanism on the second support in a position to receive a nock of the arrow when the bow and arrow is drawn, the trigger mechanism comprising at least one movable jaw and a trigger, wherein the jaw and the trigger cooperate with each other so that the jaw moves in response to movement of the trigger between a first position, when the jaw is closed, to a second position when the jaw is open, wherein the string of the bow can be captured in the jaw when the jaw is in the first position and the bow and arrow is drawn and ready to be released, said trigger mechanism not being directly connected to said bow;

d) providing an upright member for supporting the first support, the upright member having upper and lower end portions, wherein the upper end portion is connected to the first support;

e) providing a base for supporting the apparatus, wherein the base is connected to the lower end portion of the upright member;

f) wherein an assistant can draw the string of the bow to a drawn position and then operate the trigger mechanism in such a manner that the string becomes captured in the jaw while the jaw is in the first position;

g) wherein the disabled person can aim the bow and arrow at a target; and, h) wherein the disabled person can release the arrow by actuating the trigger in such, a manner as to release the arrow.

19. An apparatus for supporting a bow and arrow, the bow having a string thereon, comprising:

a) a first support, wherein the bow is disposed on said first support in an upright position ready to be drawn;

b) a second support;

c) a trigger mechanism being disposed on said second support in a position to receive a nock of the arrow when the bow and arrow is drawn, said trigger mechanism comprising at least one movable jaw and a trigger, wherein said jaw and said trigger cooperate with each other so that said jaw moves in response to movement of said trigger between a first position, when said jaw is closed, to a second position when said jaw is open, wherein the sting of the bow can be captured in said jaw when said jaw is in said first position and the bow and arrow is drawn and ready to be released;

d) an upright member for supporting said first support, said upright member having upper and lower end portions, wherein said upper end portion is connected to said first support;

e) a base for supporting the apparatus, wherein said base is connected to said lower end portion of said upright member; and f) wherein said first and second support are jointed together, wherein said first and second support have the shape of a "T" when viewed from the side.

20. A method for supporting a bow and arrow, the bow having a string thereon, comprising the steps of:

a) providing a first support, wherein the bow is disposed on the first support in an upright position, ready to be drawn;

b) providing a second support;

c) providing a trigger mechanism on the second support in a position to receive a nock of the arrow when the bow and arrow is drawn, the trigger mechanism comprising at least one movable jaw and a trigger, wherein the jaw and the trigger cooperate with each other so that the jaw moves in response to movement of the trigger between a first position, when, the jaw is closed, to a second position when the jaw is open, wherein the string of the bow can be captured in the jaw when the jaw is in the first position and the bow and arrow is drawn and ready to be released;

d) providing an upright member for supporting the first support, the upright member having upper and lower end portions, wherein the upper end portion is connected to the first support;

c) providing a base for supporting the apparatus, wherein the base is connected to the lower end portion of the upright member; and f) wherein the first and second support are jointed together, wherein the first and second support have the shape of a "T" when viewed from the side.

* * * * *